US007556105B2

(12) United States Patent
Krueger

(10) Patent No.: US 7,556,105 B2
(45) Date of Patent: Jul. 7, 2009

(54) CLOSED LOOP DRILLING ASSEMBLY WITH ELECTRONICS OUTSIDE A NON-ROTATING SLEEVE

(75) Inventor: Volker Krueger, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 9 days.

(21) Appl. No.: 11/174,768

(22) Filed: Jul. 5, 2005

(65) Prior Publication Data

US 2006/0021797 A1 Feb. 2, 2006

Related U.S. Application Data

(63) Continuation-in-part of application No. 10/439,155, filed on May 15, 2003, now Pat. No. 6,913,095.

(60) Provisional application No. 60/380,646, filed on May 15, 2002.

(51) Int. Cl.
*E21B 7/06* (2006.01)

(52) U.S. Cl. ..... 175/45; 175/61; 175/325.1

(58) Field of Classification Search ..... 175/73, 175/76, 40, 61, 62, 24, 45, 325.1, 325.3
See application file for complete search history.

(56) References Cited

U.S. PATENT DOCUMENTS 5,220,963 A 6/1993 Patton
5,341,886 A 8/1994 Patton
6,158,529 A 12/2000 Dorel
6,206,108 B1 * 3/2001 MacDonald et al. ..... 175/24
6,233,524 B1 5/2001 Dubinsky et al.
6,847,304 B1 * 1/2005 McLoughlin ..... 340/854.3
2001/0042643 A1 11/2001 Krueger et al.
2002/0053470 A1 * 5/2002 Noe et al. ..... 175/62
2004/0016571 A1 1/2004 Krueger

FOREIGN PATENT DOCUMENTS

DE 0744526 B1 * 11/1996
WO WO98/34003 8/1998
WO WO 9834003 A1 * 8/1998
WO WO00/28188 5/2000

* cited by examiner

*Primary Examiner*—Kenneth Thompson
(74) *Attorney, Agent, or Firm*—Madan & Sriram, P.C.

(57) ABSTRACT

A closed-loop drilling system utilizes a bottom hole assembly ("BHA") having a steering assembly having a rotating member and a non-rotating sleeve disposed thereon. The non-rotating sleeve has a plurality of expandable force application members that engage a borehole wall. An orientation sensing system associated with the rotating member and the non-rotating sleeve provides signals to determine an orientation of the non-rotating sleeve relative to the rotating member. In one embodiment, the orientation sensing system includes a first member positioned in the non-rotating sleeve and a second member positioned in the rotating member. Orientation of the non-rotating sleeve relative to the rotating member is determined from the coaction between the first and second members. The orientation sensing system can use magnetic waves, electrical signals, acoustic signals, radio waves, and/or physical contact.

24 Claims, 7 Drawing Sheets

CLOSED LOOP DRILLING ASSEMBLY WITH ELECTRONICS OUTSIDE A NON-ROTATING SLEEVE

CROSS REFERENCE TO RELATED APPLICATIONS

This application is a continuation-in-part of U.S. application Ser. No. 10/439,155 file May 15, 2003 now U.S. Pat. No. 6,913,095, which takes priority from U.S. Provisional Patent Application No. 60/380,646, filed May 15, 2002.

BACKGROUND OF THE INVENTION

1. Field of the Invention

This invention relates generally to drilling assemblies that utilize a steering mechanism. More particularly, the present invention relates to downhole drilling assemblies that use a plurality of force application members to guide a drill bit.

2. Description of the Related Art

Valuable hydrocarbon deposits, such as those containing oil and gas, are often found in subterranean formations located thousands of feet below the surface of the Earth. To recover these hydrocarbon deposits, boreholes or wellbores are drilled by rotating a drill bit attached to a drilling assembly (also referred to herein as a "bottom hole assembly" or "BHA"). Such a drilling assembly is attached to the downhole end of a tubing or drill string made up of jointed rigid pipe or a flexible tubing coiled on a reel ("coiled tubing"). Typically, a rotary table or similar surface source rotates the drill pipe and thereby rotates the attached drill bit. A downhole motor, typically a mud motor, is used to rotate the drill bit when coiled tubing is used.

Sophisticated drilling assemblies, sometimes referred to as steerable drilling assemblies, utilize a downhole motor and steering mechanism to direct the drill bit along a desired wellbore trajectory. Such drilling assemblies incorporate a drilling motor and a non-rotating sleeve provided with a plurality of force application members. The drilling motor is a turbine-type mechanism wherein high pressure drilling fluid passes between a stator and a rotating element (rotor) that is connected to the drill bit via a shaft. This flow of high pressure drilling fluid rotates the rotor and thereby provides rotary power to the connected drill bit.

The drill bit is steered along a desired trajectory by the force application members that, either in unison or independently, apply a force on the wall of the wellbore. The non-rotating sleeve is usually disposed in a wheel-like fashion around a bearing assembly housing associated with the drilling motor. These force application members that expand radially when energized by a power source such as an electrical device (e.g., electric motor) or a hydraulic device (e.g., hydraulic pump).

Certain steerable drilling assemblies are adapted to rotate the drill bit by either a surface source or the downhole drilling motor, or by both at the same time. In these drilling assemblies, rotation of the drill string causes the drilling motor, as well as the bearing assembly housing, to rotate relative to the wellbore. The non-rotating sleeve, however, remains generally stationary relative to the wellbore when the force application members are actuated. Thus, the interface between the non-rotating sleeve and the bearing assembly housing need to accommodate the relative rotational movement between these two parts.

Steerable drilling assemblies typically use formation evaluation sensors, guidance electronics, motors and pumps and other equipment to control the operation of the force application members. These sensors can include accelerometers, inclinometers gyroscopes and other position and direction sensing equipment. These electronic devices are conventionally housed within in the non-rotating sleeve rather than the bearing assembly or other section of the steerable drilling assembly. The placement of electronics within the non-rotating sleeve raises a number of considerations.

First, a non-rotating sleeve fitted with electronics requires that power and communication lines run across interface between the non-rotating sleeve and bearing assembly. Because the bearing assembly can rotate relative to the non-rotating sleeve, the non-rotating sleeve and the rotating housing must incorporate a relatively complex connection that bridges the gap between the rotating and non-rotating surface.

Additionally, a steering assembly that incorporates electrical components and electronics into the non-rotating sleeve raises considerations as to shock and vibration. As is known, the interaction between the drill bit and formation can be exceedingly dynamic. Accordingly, to protect the on-board electronics, the non-rotating sleeve is placed a distance away from the drill bit. Increasing the distance between the force application members and the drill bit, however, reduces the moment arm that is available to control the drill bit. Thus, from a practical standpoint, increasing the distance between the non-rotating sleeve and the drill bit also increases the amount of force the force application members must generate in order to urge the drill bit in desired direction.

Still another consideration is that the non-rotating sleeve must be sized to accommodate all the on-board electronics and electro mechanical equipment. The overall dimensions of the non-rotating sleeve, thus, may be a limiting factor in the configuration of a drilling assembly, and particularly the arrangement of near-bit tooling and equipment.

The present invention is directed to addressing one or more of the above stated considerations regarding conventional steering assemblies used with drilling assemblies.

SUMMARY OF THE INVENTION

In one aspect, the present invention provides drilling assembly having a steering assembly for steering the drill bit in a selected direction. In one embodiment, the steering assembly is integrated into the bearing assembly housing of a drilling motor. The steering assembly may, alternatively, be positioned within a separate housing that is operationally and/or structurally independent of the drilling motor. The steering assembly includes a non-rotating sleeve disposed around a rotating housing portion of the BHA, a power source, and a power circuit. The sleeve is provided with a plurality of force application members that expand and contract in order to engage and disengage the borehole wall of the wellbore.

In embodiments, the drilling assembly includes an orientation sensing system associated with the rotating member and the non-rotating sleeve provides signals to determine an orientation of the non-rotating sleeve relative to the rotating member. In one arrangement, the orientation sensing system includes a first member positioned in the non-rotating sleeve and a second member positioned in the rotating member. Orientation of the non-rotating sleeve relative to the rotating member can be determined from the coaction between the first and second members. The orientation sensing system can use magnetic waves, electrical signals, acoustic signals, radio waves, physical contact and other any other suitable media or action. In one embodiment, the first member includes a passive material, and the second member includes a sensor adapted to detect the passive material. In another embodiment, the second member can be a magnetic pickup that detects a magnetic field emitted from the non-rotating member. Additionally, embodiments of the drilling assembly can use a processor programmed to determine the orientation of the non-rotating member relative to the rotating member in response to a signal provided by the orientation sensing system. The processor can be programmed to steer the drilling assembly based on the determined orientation, transmit the orientation data to the surface, or take some other programmed action. For instance, the processor can be programmed to determine the orientation of the non-rotating member based on a parameter of interest relating to the rotating member. Suitable parameters of interest include rotational speed, azimuth, inclination, and depth.

In one embodiment, the BHA includes a surface control unit, one or more BHA sensors, and a BHA processor. The BHA includes known components such as drill string, a telemetry system, a drilling motor and a drill bit. The surface control unit and the BHA processor cooperate to guide the drill bit along a desired well trajectory by operating the steering assembly in response to parameters detected by one or more BHA sensors and/or surface sensors. The BHA sensors are configured to detect BHA orientation and formation data. The BHA sensors provides data via the telemetry system that enables the control unit and/or BHA processor to at least (a) establish the orientation of the BHA, including the non-rotating sleeve, (b) compare the BHA position with a desired well profile or trajectory and/or target formation, and (c) issue corrective instructions, if needed, to steer the BHA to the desired well profile and/or toward the target formation.

In one closed-loop mode of operation, the control unit and BHA processor include instructions relating to the desired well profile or trajectory and/or desired characteristics of a target formation. The control unit maintains overall control over the drilling activity and transmits command instructions to the BHA processor. The BHA processor controls the direction and progress of the BHA in response to data provided by one or more BHA sensors and/or surface sensors, including the orientation sensing system. For example, if sensor azimuth and inclination data indicates that the BHA is straying from the desired well trajectory, then the BHA processor automatically adjusts the force application members of the steering assembly in a manner that steers the BHA to the desired well trajectory. The operation is continually or periodically repeated, thereby providing an automated closed-loop drilling system for drilling oilfield wellbores with enhanced drilling rates and with extended drilling assembly life.

It should be understood that examples of the more important features of the invention have been summarized rather broadly in order that detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DETAILED DESCRIPTION OF THE PREFERRED EMBODIMENT

Figure 1:
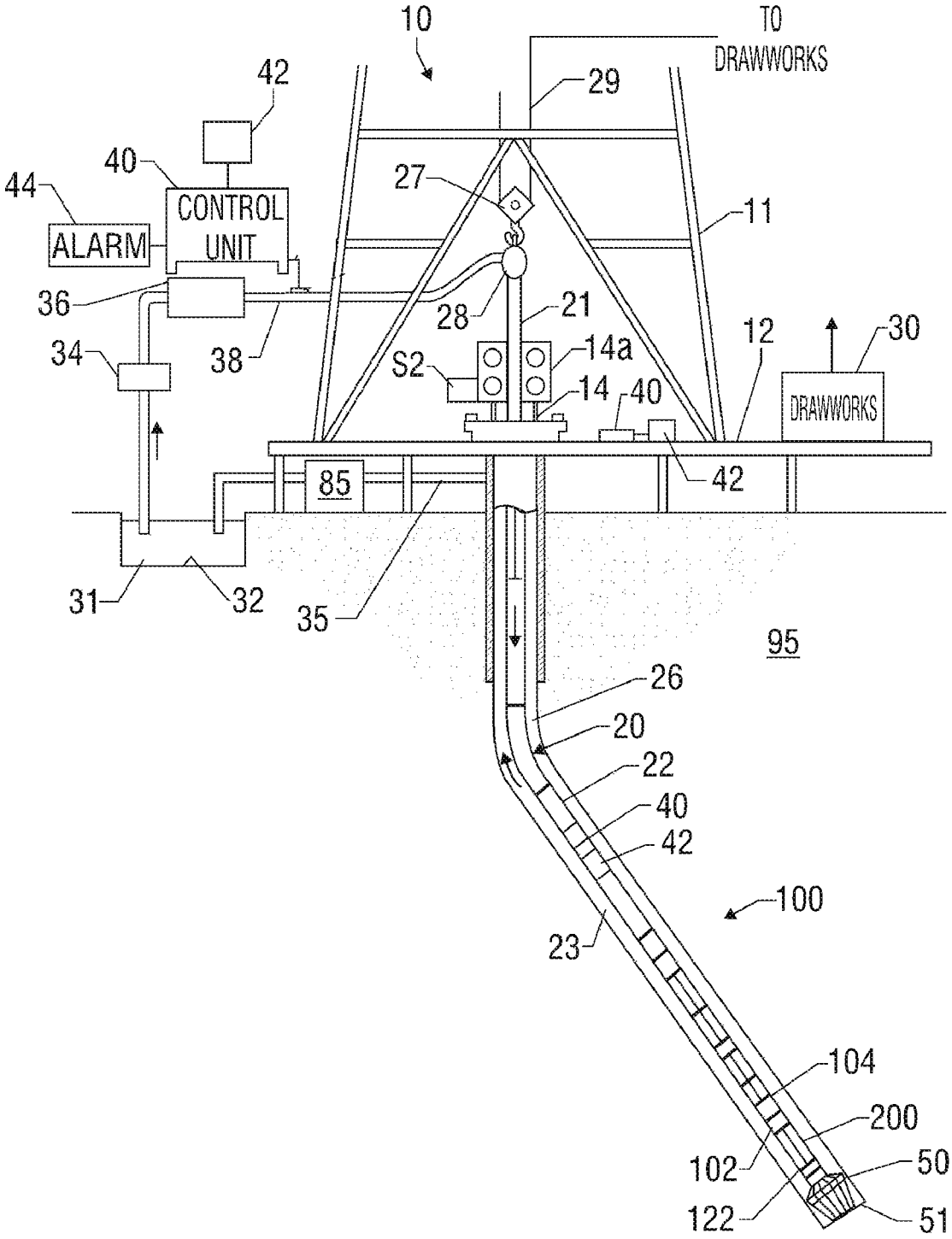
FIG. 1 shows a schematic diagram of a drilling system with a bottom hole assembly according to one embodiment of the present invention.

The present invention relates to devices and methods providing rugged and efficient guidance of a drilling assembly adapted to form a wellbore in a subterranean formation. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein.

Referring initially to FIG. 1 there is shown a schematic diagram of a drilling system 10 having a bottom hole assembly (BHA) or drilling assembly 100 shown conveyed in a borehole 26 formed in a formation 95. The drilling system 10 includes a conventional derrick 11 erected on a floor 12 which supports a rotary table 14 that is rotated by a prime mover such as an electric motor (not shown) at a desired rotational speed. The drill string 20, which includes a tubing (drill pipe or coiled-tubing) 22, extends downward from the surface into the borehole 26. A tubing injector 14*a* is used to inject the BHA 100 into the wellbore 26 when a coiled-tubing is used. A drill bit 50 attached to the drill string 20 disintegrates the geological formations when it is rotated to drill the borehole 26. The drill string 20 is coupled to a drawworks 30 via a kelly joint 21, swivel 28 and line 29 through a pulley 27. The operations of the drawworks 30 and the tubing injector are known in the art and are thus not described in detail herein.

The drilling system also includes a telemetry system 39 and surface sensors, collectively referred to with $S_2$. The telemetry system 39 enables two-way communication between the surface and the drilling assembly 100. The telemetry system 39 may be mud pulse telemetry, acoustic telemetry, an electromagnetic telemetry or other suitable communication system. The surface sensors $S_2$ include sensors that provide information relating to surface system parameters such as fluid flow rate, torque and the rotational speed of the drill string 20, tubing injection speed, and hook load of the drill string 20. The surface sensors $S_2$ are suitably positioned on surface equipment to detect such information. The use of this information will be discussed below. These sensors generate signals representative of its corresponding parameter, which signals are transmitted to a processor by hard wire, magnetic or acoustic coupling. The sensors generally described above are known in the art and therefore are not described in further detail.

During drilling, a suitable drilling fluid 31 from a mud pit (source) 32 is circulated under pressure through the drill string 20 by a mud pump 34. The drilling fluid passes from the mud pump 34 into the drill string 20 via a desurger 36 and the fluid line 38. The drilling fluid 31 discharges at the borehole bottom 51 through openings in the drill bit 50. The drilling fluid 31 circulates uphole through the annular space 23 between the drill string 20 and the borehole 26 and returns to the mud pit 32 via a return line 35 and drill cutting screen 85 that removes drill cuttings from the returning drilling fluid. To optimize drilling operations, one drilling system 10 includes processors that cooperate to control BHA 100 operation.

The processors of the drilling system 10 include a control unit 40 and one or more BHA processors 42 that cooperate to analyze sensor data and execute programmed instructions to achieve more effective drilling of the wellbore. The control unit 40 and BHA processor 42 receives signals from one or more sensors and process such signals according to programmed instructions provided to each of the respective processors.

Figure 2:
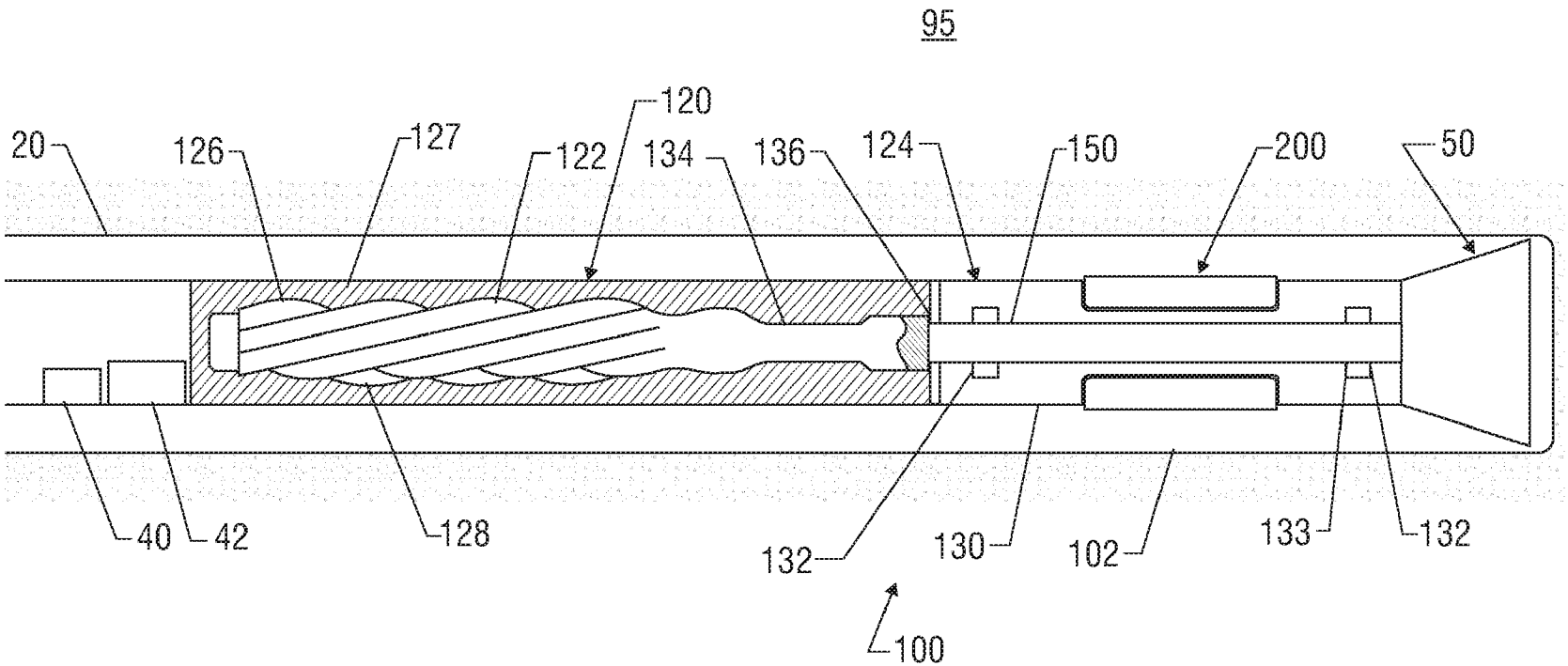
FIG. 2 shows a sectional schematic view of one steering assembly used in conjunction with a bottom hole assembly.
Figure 3:
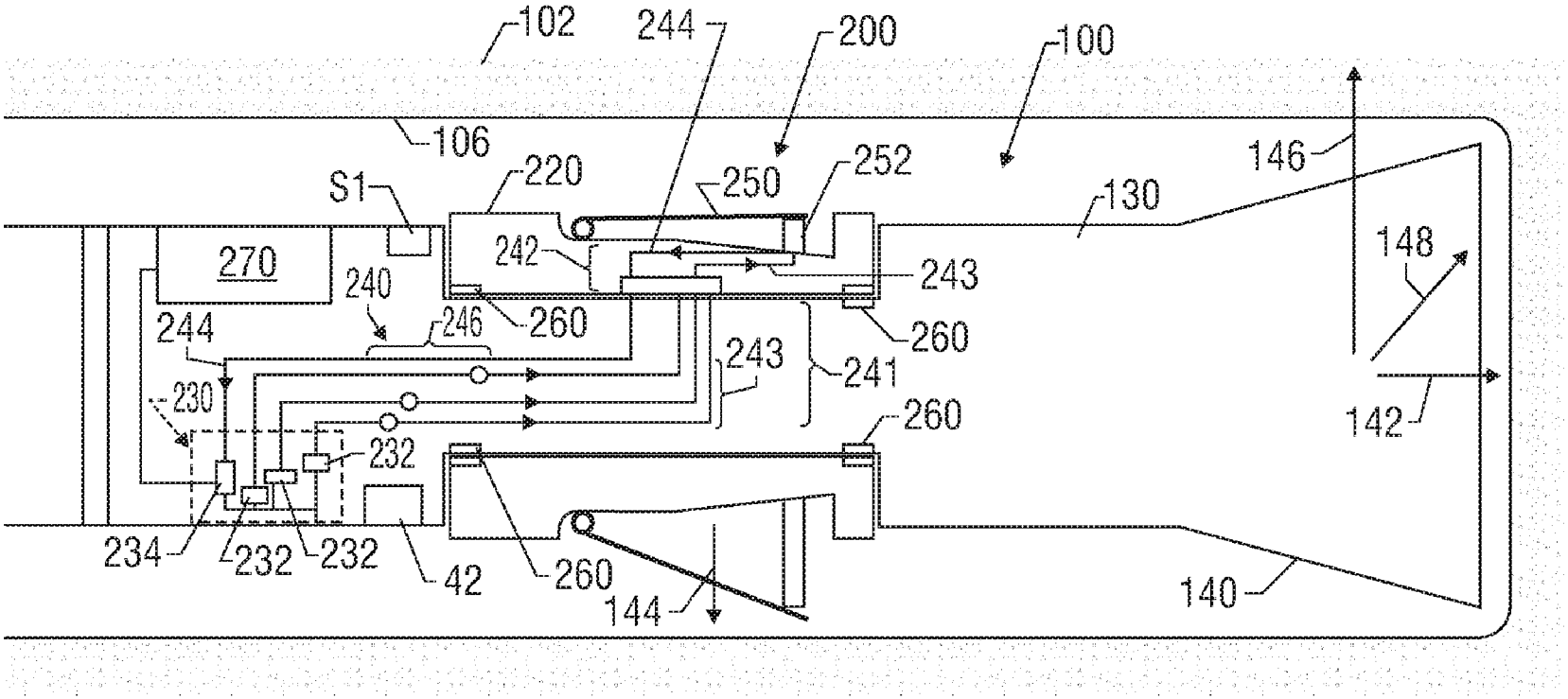
FIG. 3 schematically illustrates a steering assembly made in accordance with one embodiment of the present invention.

The surface control unit 40 displays desired drilling parameters and other information on a display/monitor 44 that is utilized by an operator to control the drilling operations. The BHA processor 42 may be positioned close to the steering assembly 200 (as shown in FIG. 3) or positioned in a different section of the BHA 100 (as shown in FIG. 2). Each processor 40,42 contains a computer, memory for storing data, recorder for recording data and other known peripherals.

Referring now to FIG. 2, there is shown one embodiment of the present invention utilized in an exemplary steerable drilling assembly 100. The drilling assembly 100 includes the drill string 20, a drilling motor 120, a steering assembly 200, the BHA processor 42, and the drill bit 50.

The drill string 20 connects the drilling assembly 100 to surface equipment such as mud pumps and a rotary table. The drill string 20 is a hollow tubular through which high pressure drilling fluid ("mud") 31 is delivered to the drill bit 50. The drill string 20 is also adapted to transmit a rotational force generated at the surface to the drill bit 50. The drill string 20, of course, can perform a number of other tasks such as providing the weight-on-bit for the drill bit 50 and act as a transmission medium for acoustical telemetry systems (if used).

The drilling motor 120 provides a downhole rotational drive source for the drill bit 50. The drilling motor 120 contains a power section 122 and a bearing assembly 124. The power section 122 includes known arrangement wherein a rotor 126 rotates in a stator 127 when a high-pressure fluid passes through a series of openings 128 between the rotor 126 and the stator 127. The fluid may be a drilling fluid or "mud" commonly used for drilling wellbores or it may be a gas or a liquid and gas mixture. The rotor is coupled to a rotatable shaft 150 for transferring rotary power generated by the drilling motor 120 to the drill bit 50. The drilling motor 120 and drill string 20 are configured to independently rotate the drill bit 50. Accordingly, the drill bit 50 may be rotated in any one of three modes: rotation by only the drill string 20, rotation by only the drilling motor 120, and rotation by a combined use of the drill string 20 and drilling motor 120.

The bearing assembly 124 of the drilling motor 120 provides axial and radial support for the drill bit 50. The bearing assembly 124 contains within its housing 130 one or more suitable radial or journal bearings 132 that provide lateral or radial support to the drive shaft 150. The bearing assembly 124 also contains one or more suitable thrust bearings 133 to provide axial support (longitudinal or along wellbore) to the drill bit 50. The drive shaft 150 is coupled to the drilling motor rotor 126 by a flexible shaft 134 and suitable couplings 136. Various types of bearing assemblies are known in the art and are thus not described in greater detail here. It should be understood that the bearing assembly 124 has been described as part of the drilling motor 120 merely to follow the generally accepted nomenclature of the industry. The bearing assembly 124 may alternatively be a device that is operationally and/or structurally independent of the drilling motor 120. Thus, the present invention is not limited to any particular bearing configuration. For example, there is no particular minimum or maximum number of radial or thrust bearings that must be present in order to advantageously apply the teachings of the present invention.

Preferably, the steering assembly 200 is integrated into the bearing assembly housing 130 of the drilling assembly 100. The steering assembly 200 steers the drill bit 50 in a direction determined by the control unit 40 (FIG. 1) and/or the BHA processor 42 in response to one or more downhole measured parameters and predetermined directional models. The steering assembly 200 may, alternatively, be housed within a separate housing (not shown) that is operationally and/or structurally independent of the bearing assembly housing 130.

Referring now to FIG. 3, one steering assembly 200 includes a non-rotating sleeve 220, a power source 230, a power circuit 240, a plurality of force application members 250, seals 260 and a sensor package 270. As will be explained below, any components (e.g., control electronics) for controlling the power supplied to the force application member 250 are located outside of the non-rotating sleeve 220. Such components can be placed in the bearing assembly housing 130. Referring briefly to FIG. 1, in other embodiments, these components can be positioned in a rotating member such as the rotating drill shaft 22, in a sub 102 positioned adjacent the drilling motor 122 (FIG. 2), an adjacent non-rotating member 104 and/or at other suitable locations in the drilling assembly 200. Likewise, the operative force required to expand and retract the force application member 250 is also located in the housing 130 or other location previously discussed. Therefore, preferably, the only equipment for controlling the power supplied to the force application members 250 that is placed within the non-rotating sleeve 220 is a portion of the power circuit 240.

The force application members 250 move (e.g., extend and retract) in order to selectively apply force to the borehole wall 106 of the wellbore 26. Preferably, force application members 250 are ribs that can be actuated together (concentrically) or independently (eccentrically) in order to steer the drill bit 50 in a given direction. Additionally, the force application members 250 can be positioned at the same or different incremental radial distances. Thus, the force applications members 250 can be configured to provide a selected amount of force and/or move a selected distance (e.g., a radial distance). In one embodiment, a device such as piezoelectric elements (not shown) can be used to measure the steering force at the force application members 250. Other structures such as pistons or expandable bladders may also be used. It is known that the drilling direction can be controlled by applying a force on the drill bit 50 that deviates from the axis of the borehole tangent line. This can be explained by use of a force parallelogram depicted in FIG. 3. The borehole tangent line is the direction in which the normal force (or pressure) is applied on the drill bit 50 due to the weight-on-bit, as shown by the arrow 142. The force vector that deviates from this tangent line is created by a side force applied to the drill bit 50 by the steering device 200. If a side force such as that shown by arrow 144 (Rib Force) is applied to the drilling assembly 100, it creates a force 146 on the drill bit 50 (Bit Force). The resulting force vector 148 then lies between the weight-on-bit force line (Bit Force) depending upon the amount of the applied Rib Force.

The power source 230 provides the power used to actuate the ribs 250. Preferably, the power source 230 is a closed hydraulic fluid based system wherein the movement of the rib 250 may be accomplished by a piston 252 that is actuated by high-pressure hydraulic fluid. Also, a separate piston pump 232 independently controls the operation of each steering rib 250. Each such pump 232 is preferably an axial piston pump 232 disposed in the bearing assembly housing 130.

In one embodiment, the piston pumps 232 are hydraulically operated by the drill shaft 150 (FIG. 2) utilizing the drilling fluid flowing through the bearing assembly housing 130. Alternatively, a common pump may be used to energize all the force application members 250. In still another embodiment, the power source 230 may include an electrical power delivery system that energizes an electric motor and, for example, a threaded drive shaft that is operatively connected to the force application member 250. The selection of a particular power source arrangement is dependent on such factors as the amount of power required to energize the force application members, the power demands of other downhole equipment, and severity of the downhole environment. Other factors affecting the selection of a power source will be apparent to one of ordinary skill in the art.

The power circuit 240 transmits the power generated by the power source 230 to the force application members 250. Where the power source is hydraulically actuated arrangement, as described above, the power circuit 240 includes a plurality of lines that are adapted to convey the high-pressure fluid to the force application members 250 and to return the fluid from the force application members 250 to a sump 234 in the power source 230. A power circuit 240 so configured includes a housing section 241 and a non-rotating sleeve section 242. Each section 241, 242 includes supply lines collectively referred with numeral 243 and one or more return lines collectively referred to with numeral 244. The power source 250 can control one or more parameters of the hydraulic fluid (e.g., pressure of flow rate) to thereby control the force application members 250. In one arrangement, the pressure of the fluid provided to the force application members 250 can be measured by a pressure transducer (not shown) and these measurements can be used to control the force application members 250.

The housing section 241 also includes one or more control valve and valve actuators, collectively referred to with numeral 246, disposed between each piston pump 232 and its associated steering rib 250 to control one or more parameters of interest (e.g, pressure and/or flow rate) of the hydraulic fluid from such piston pump 232 to its associated steering rib 250. Each valve actuator 246 controls the flow rate through its associated control valve 246. The valve actuator 246 may be a solenoid, magnetostrictive device, electric motor, piezoelectric device or any other suitable device. To supply the hydraulic power or pressure to a particular steering rib 250, the valve actuator 246 is activated to allow hydraulic fluid to flow to the rib 250. If the valve actuator 246 is deactivated, the control valve 246 is blocked, and the piston pump 232 cannot create pressure in the rib 250. In one mode of drilling, all piston pumps 232 are operated continuously by the drive shaft 150. The valves and valve actuators can also utilize proportional hydraulics.

One method of energizing the ribs 250 utilizes a duty cycle. In this method, the duty cycle of the valve actuator 246 is controlled by processor or control circuit (not shown) disposed at a suitable place in the drilling assembly 100. The control circuit may be placed at any other location, including at a location above the power section 122.

Figure 4:
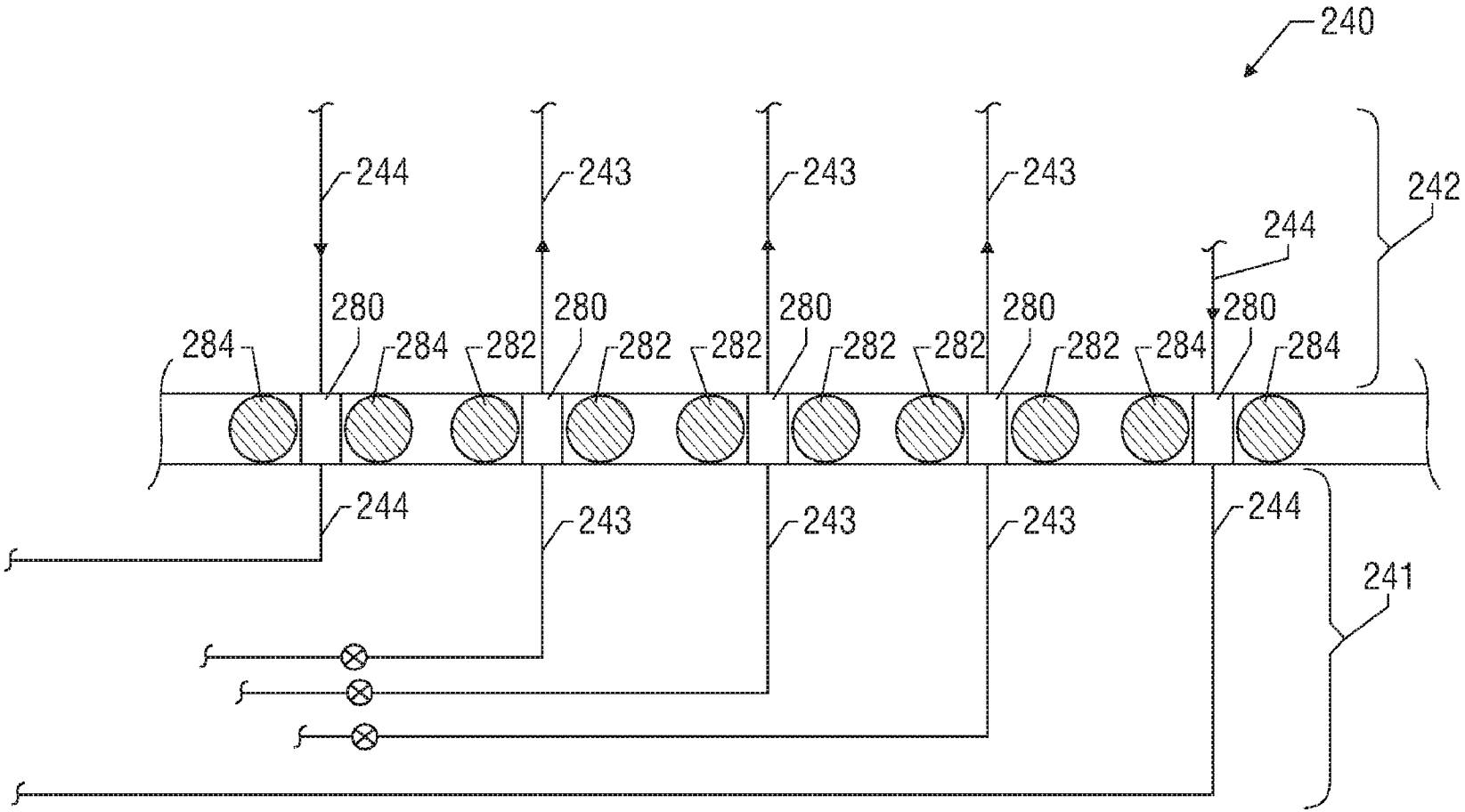
FIG. 4 schematically illustrates a hydraulic circuit used in one embodiment of the invention.

Referring now to FIG. 4, there is shown an exemplary power circuit 240. The power circuit 240 includes a sleeve section 242 and a housing section 241. In the illustrated embodiment, the housing section 241 includes a plurality of supply lines 243 and return lines 244. The housing section lines 243 and 244 connect with complimentary lines 240, 243 and 244 in the sleeve section 242. Because there is rotating contact between the housing 241 and the sleeve 242, a mechanism such as a multi-channel hydraulic swivel or slip ring 280 is used to connect the lines of the housing section 241 and the sleeve section 242.

Hydraulic slip rings 280 and seals 282 and 284 of the power circuit 240 enable the transfer of high-pressure and low-pressure hydraulic fluid between the power source 230 and force application members 250 at the rotating interface between the housing section 130 and the non-rotating sleeve 220. Hydraulic slip rings 280 convey the high-pressure hydraulic fluid from lines 243 of the power circuit housing section 241 to the corresponding lines 243 of the power circuit sleeve section 242. The seals 282 and 284 prevent leakage of the hydraulic fluid and also prevent drilling fluid from invading the power circuit 240. Preferably, seals 282 are mud/oil seals adapted for a low-pressure environment and seals 284 are oil seals adapted for a high-pressure environment. This arrangement recognizes that the fluid being conveyed to the force application members 250 via lines 243 are at high pressure whereas the return lines 244 are conveying fluids at low pressure.

Figure 5:
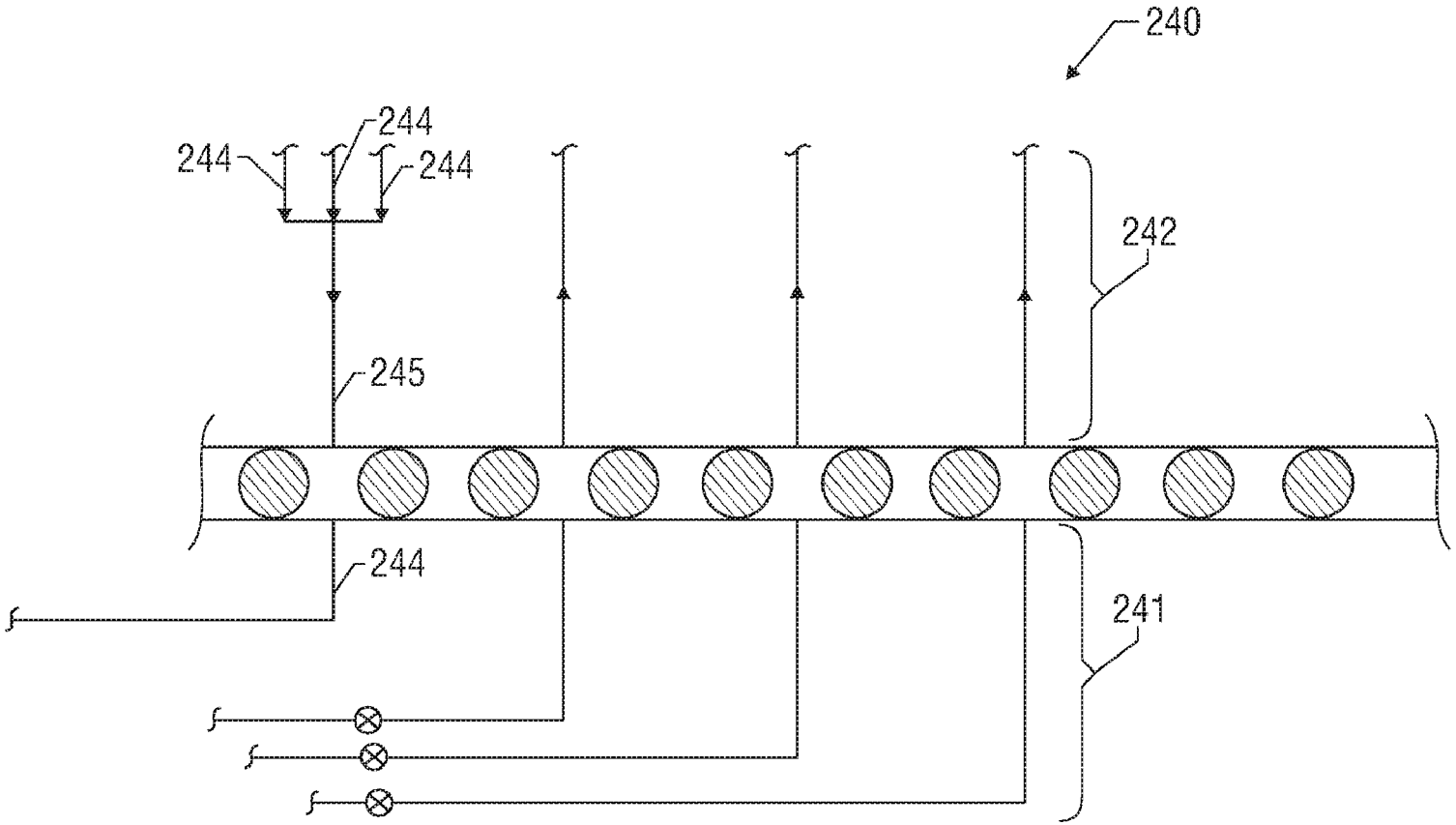
FIG. 5 schematically illustrates an alternate hydraulic circuit used in conjunction with an embodiment of the present inventions.

It will be understood that the power circuit 240 may have as many supply lines 243 as there are force application members. Referring now to FIG. 5, the return lines 244 may be modified to optimize the overall hydraulic arrangement. For example, the sleeve section 242 may consolidate the return lines 244 from each of the force application members 250 (FIG. 6) into a single line 245 which then communicates with a single return line 244 in the housing section 241. Alternatively, one or more supply lines 243 may be dedicated to the each of the force application members 250. Thus, the overall architecture of the power circuit 250 depends on power source used to actuate the force application members 250.

Referring now to FIGS. 2 and 3, the non-rotating sleeve 220 provides a stationary base from which the force application members 250 can engage the borehole wall 106. The non-rotating sleeve 220 is generally a tubular element that is telescopically disposed around the bearing assembly housing 130. The sleeve 220 engages the housing 130 at bearings 260. The bearings 260 may include a radial bearing 262 that facilitates the rotational sliding action between the sleeve 220 and the housing 130 and a thrust bearing 264 that absorbs the axial loadings caused by the thrust of the drill bit 50 against the borehole wall 106. Preferably, bearings 260 include mud-lubricated journal bearings 262 disposed outwardly on the sleeve 220.

Referring now to FIG. 3, the sensor package 270 includes one or more BHA sensors $S_1$, a BHA orientation-sensing system, and other electronics that provide the information used by the processors 40,42 to steer the drill bit 50. The sensor package 270 provides data that enables the processors 40,42 to at least (a) establish the orientation of the BHA 100, (b) compare the BHA 100 position with the desired well profile or trajectory and/or target formation, and (c) issue corrective instructions, if needed, to return the BHA 100 to the desired well profile and/or toward the target formation. The BHA sensors $S_1$ detect data relating to: (a) formation related parameters such as formation resistivity, dielectric constant, and formation porosity; (b) the physical and chemical properties of the drilling fluid disposed in the BHA; (c)

"drilling parameters" or "operations parameters," which include the drilling fluid flow rate, drill bit rotary speed, torque, weight-on-bit or the thrust force on the bit ("WOB"); (d) the condition and wear of individual devices such as the mud motor, bearing assembly, drill shaft, tubing and drill bit; and (e) the drill string azimuth, true coordinates and direction in the wellbore 26 (e.g., position and movement sensors such as an inclinometer, accelerometers, magnetometers or a gyroscopic devices). BHA sensors $S_1$ can be dispersed throughout the length of the BHA 100. The above-described sensors generates signals representative of its corresponding parameter of interest, which signals are transmitted to a processor by hard wire, magnetic or acoustic coupling. The sensors generally described above are known in the art and therefore are not described in detail herein.

Figure 6:
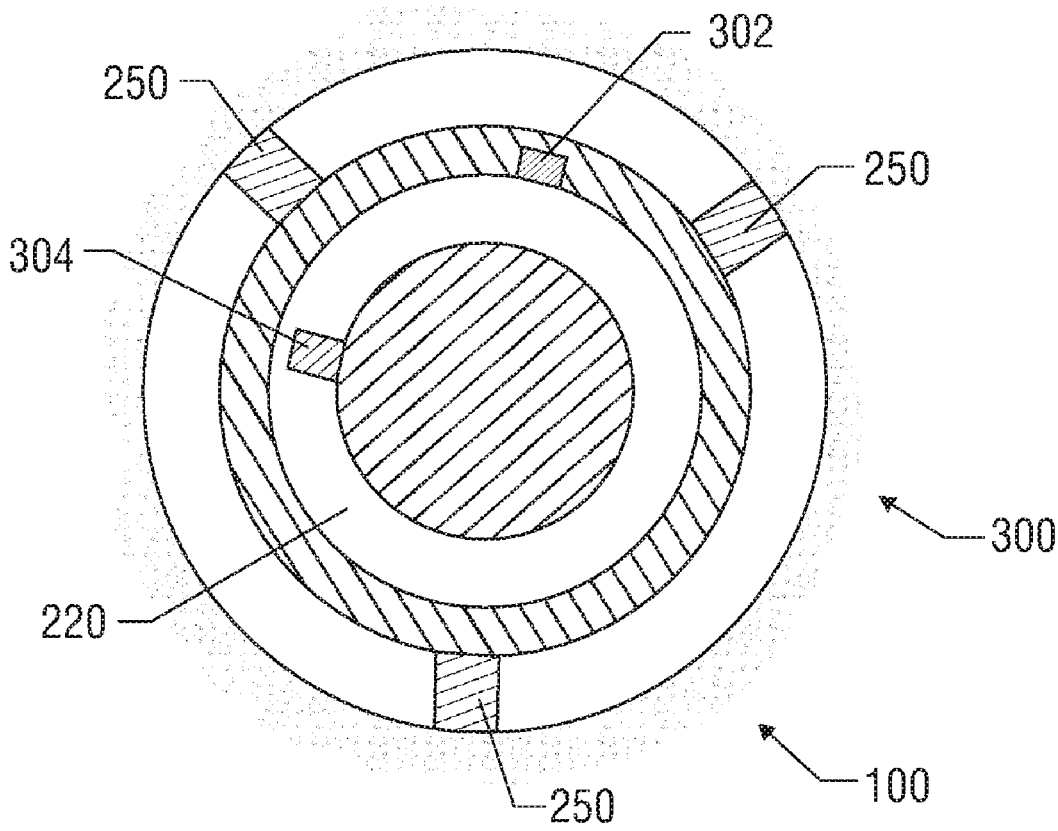
FIG. 6 shows a cross-sectional view of an exemplary orientation detection system made in accordance with the present invention.

Referring now to FIG. 6, there is shown an exemplary orientation-sensing system 300 for determining the orientation (e.g., tool face orientation) of the sleeve 220 and force application members 250 relative to the drilling assembly 100. The orientation-sensing system 300 includes a first member or element 302 positioned on the non-rotating sleeve 220, and a second member or element 304 positioned on the rotating housing 130. This first member 302 is positioned at a fixed relationship with respect to one or more of the force application members 250 and either actively or passively provides an indication of its position relative to the second member 304. For example, the first member 220 can actively emit a signal such as an electrical signal, a magnetic wave, or an acoustic signal. A passive first member 220 can be made of a material such as a metal that can be detected by a suitable sensor. In one embodiment, an orientation-sensing system 300 includes a magnet 302 positioned at a known pre-determined angular orientation on the non-rotating sleeve 220 with the respect to the force application members 250. It should be understood that the term "magnet" refers broadly to any material that emits magnetic waves. While a bar or rectangular shaped magnet is shown, it should be understood that any material that having a magnetic quality, regardless of configuration, can be used. A sensor adapted to detect magnetic signals such as a magnetic pickup 304, which is mounted on the housing 130, will come into contact with magnetic fields of the magnetic during rotation. The location of the magnetic pickup relative to the rotating housing 130 is, of course, known. Because the rotation speed, inclination and orientation of the housing 130 is known, the position of the force application members 250 may be calculated as needed by the BHA processor 42 (FIGS. 2 and 3).

Figure 7:
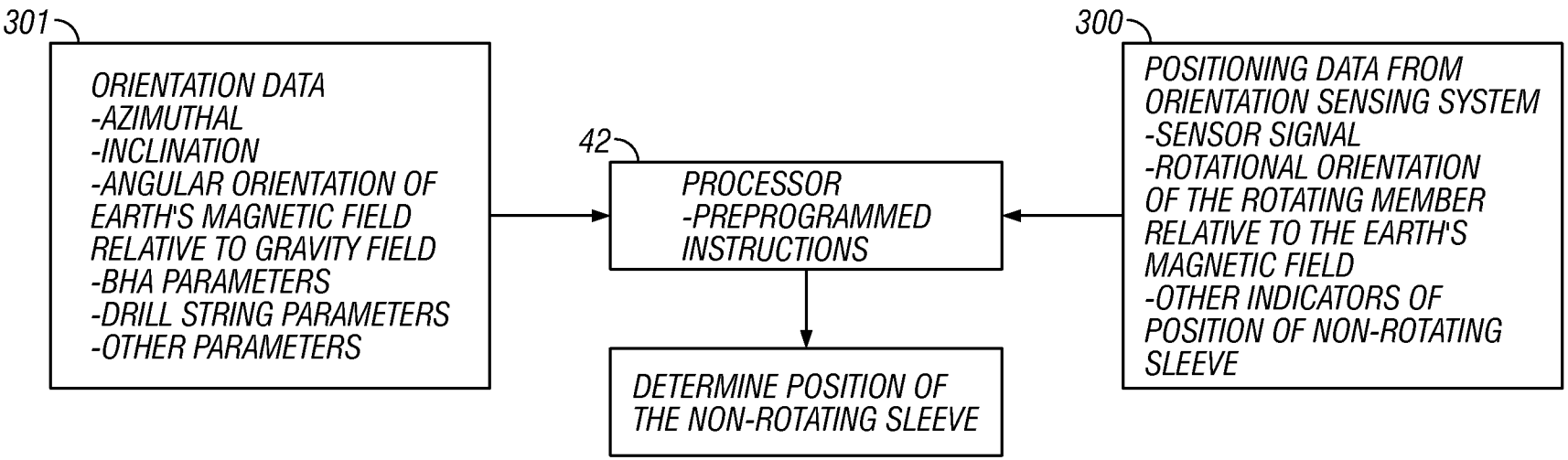
FIG. 7 is a flowchart illustrating one exemplary method of determining the position of a non-rotating sleeve.

Referring now to FIGS. 6 and 7, in one mode of operation, the processor 42 periodically or continually receives position signals from the orientation sensing system 300. Signals can be transmitted by a magnetic pickup signal. These position signals can be generated, for example, when the first member is proximate to the second member or in a particular relation with each other. In another arrangement, a position signal can be emitted when the first member is not proximate to the second member. Other signals can transmit information relating to the rotational orientation of the housing 130 relative to the earth's magnetic field. Still other data indicative of the position of the non-rotating sleeve may be transmitted to the processor 42. The processor 42 also receives data 301 relating to the orientation of the BHA and/or drill string. This orientation data 301 includes azimuth, inclination, angular orientation of earth's magnetic field relative to gravity field, BHA parameters, drill string parameters, and other parameters indicative of the orientation of the BHA and/or drill string. The processor 42 utilizes the position data from the orientation sensing system 300 in conjunction with the orientation data 301 one or more measurements of other parameters of interest, such as the -rotational orientation of the housing 130 relative to the earth's magnetic field and orientation data such as azimuth, inclination, angular orientation of the earth's magnetic field relative to the earth's gravity to determine the relative orientation of the non-rotating sleeve. Based on the orientation determination, the processor 42 can be programmed to alter the position of one or more of the force application members to steer the drilling assembly (e.g., maintain a predetermined trajectory). In one mode of operation, the orientation is determined downhole during the drilling of the wellbore. In another mode of operation the orientation may be determined at the surface from information provided by the drilling assembly during drilling of the wellbore. The information sent to the surface may be the signals from the orientation sensing system or processed data in response to the signals from the orientation sensing system.

Other arrangements for determining orientation of the non-rotating sleeve may include a sensor in the non-rotating sleeve that measures orientation relative to a known parameter such as the earth's magnetic field or gravity. The data from the sensor can be transmitted via a suitable coupling (e.g., electrical slip rings or inductive coupling) from the non-rotating sleeve to the rotating housing.

It will be apparent to one of ordinary skill in the art that other arrangements may be used in lieu of magnetic signals. Such other arrangements for detecting orientation include inductive transducers (linear variable differential transformers), coil or hall sensors, and capacity sensors. Still other arrangements can use radio waves, electrical signals, acoustic signals, and interfering physical contact between the first and second members. Additionally, accelerometers can be used to determine a trigger point relative to a position, such as hole high side, to correct tool face orientation. Moreover, acoustic sensors can be used to determine the eccentricity of the assembly 100 relative to the wellbore.

Referring now to FIG. 5, the sensor package 270 can provide the processor 40,42 with an indication of the status of the steering assembly 200 by monitoring the power source 230 to determine the amount or the magnitude of the hydraulic pressure (e.g., measurements from a pressure transducer) for any given force application member and the duty cycle to which that force application member 250 may be subjected. The processors 40,42 can use this data to determine the amount of force that the force application members 250 are applying to the borehole wall 106 at any given time.

In one embodiment of a closed-loop mode of operation, the processors 40,42 include instructions relating to the desired well profile or trajectory and/or desired characteristics of a target formation. The control unit 40 maintains control over aspects of the drilling activity such as monitoring for system dysfunctions, recording sensor data, and adjusting system 10 setting to optimize, for example, rate of penetration. The control unit 40, either periodically or as needed, transmits command instructions to the BHA processor 42. In response to the command instructions, the BHA processor 42 controls the direction and progress of the BHA 100. During an exemplary operation, the sensor package 270 provides orientation readings (e.g., azimuth and inclination) and data relating to the status of the force application members 250 to the BHA processor 42. Using a predetermined wellbore trajectory stored in a memory module, the BHA processor 42 uses the orientation and status data to reorient and adjust the force application members 250 to guide the drill bit 50 along the predetermined wellbore trajectory. During another exemplary operation, the sensor package 270 provides data relating to a pre-determined formation parameter e.g., resistivity).

The BHA processor 42 can use this formation data to determine the proximity of the BHA 100 to a bed boundary and issue steering instructions that prevents the BHA 100 from exiting the target formation. This automated control of the BHA 100 may include periodic two-way telemetric communication with the control unit 40 wherein the BHA processor 42 transmits selected sensor data and processed data and receives command instructions. The command instructions transmitted by the control unit 40 may, for instance, be based on calculations based on data received from the surface sensors $S_2$. As noted earlier, the surface sensors $S_2$ provide data that can be relevant to steering the BHA 100, e.g., torque, the rotational speed of the drill string 20, tubing injection speed, and hook load. In either instance, the BHA processor 42 controls the steering assembly 200 calculating the change in displacement, force or other variable needed to re-orient the BHA 100 in the desired direction and repositioning re-positioning the force application members to induce the BHA 100 to move in the desired direction.

As can be seen, the drilling system 10 may be programmed to automatically adjust one or more of the drilling parameters to the desired or computed parameters for continued operations. It will be appreciated that, in this mode of operation, the BHA processor transmits only limited data, some of which has already been processed, to the control unit. As is known, baud rate of conventional telemetry systems limit the amount of BHA sensor data that can be transmitted to the control unit. Accordingly, by processing some of the sensor data downhole, bandwidth of the telemetry system used by the drilling system 10 is conserved.

It should be appreciated that the processors 40,42 provide substantial flexibility in controlling drilling operations. For example, the drilling system 10 may be programmed so that only the control unit 40 controls the BHA 100 and the BHA processor 42 merely supplies certain processed sensor data to the control unit 40. Alternatively, the processors 40,42 can share control of the BHA 100; e.g., the control unit 40 may only take control over the BHA 100 when certain pre-defined parameters are present. Additionally, the drilling system 10 can be configured such that the operator can override the automatic adjustments and manually adjust the drilling parameters within predefined limits for such parameters.

It will also be appreciated that placement of the steering assembly electronics in the rotating bearing assembly rather than the non-rotating sleeve provides greater flexibility in electronics design and protection. For example, all of the drilling assembly electronics can be consolidated in a module removably fixed within the drilling assembly 100. Further, by placing the sensor package 270 and power source 230 in the housing 126, the overall size of the non-rotating sleeve 220 is correspondingly reduced. Still further, the electronics-free non-rotating sleeve 220 may be placed closer to the drill bit 50 because the instrumentation that would otherwise be subject to shock and vibration is maintained at a safe distance within the bearing assembly housing 210. This closer placement increases the moment arm available to steer the bit 50 and also reduces the unsupported length of drill shaft between the drilling motor 120 and the drill bit 50. In certain embodiments, a limited amount of electronics having selected characteristics (e.g., rugged, shock-resistant, self-contained, etc.) can be included in the non-rotating sleeve 220 while the majority of the electronics remains in the rotating housing 210.

It should be understood that the teachings of the present invention are not limited to the particular configuration of the drilling assembly described. For example, the sensor package 230 may be moved up hole of the drilling motor. Likewise the power source 230 may be moved up hole of the drilling motor. Also, there may be greater or fewer number of force application members 250.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. For example, certain self-contained electronics or other equipment may be disposed on the rotating sleeve so long as no power, communication or other connection between the non-rotating sleeve and drilling system is required to operate such equipment. Of course, the use of such systems may affect the operational advantages of the present invention. For example, such equipment may limit the degree to which the overall non-rotating sleeve may be reduced. It is intended that the following claims be interpreted to embrace all such modifications and changes.

What is claimed is:

1. A drilling assembly for drilling a wellbore, comprising:

(a) a rotating member configured to be rotated by a surface rotary power source;

(b) a non-rotating sleeve surrounding a portion of the rotating member, the sleeve having a plurality of force application members, each member adapted to extend radially outward to engage a wall of the wellbore;

(c) a first member positioned on the non-rotating sleeve; and (d) an orientation sensing system associated with the rotating member that detects the first member and provides signals to determine an orientation of the non-rotating sleeve relative to the rotating member and wherein the orientation of the non-rotating sleeve relative to the rotating member is determined from detecting the first member.

2. The drilling assembly of claim 1 wherein the orientation sensing system utilizes one of (i) magnetic waves, (ii) electrical signals, (iii) acoustic signals, (iv) radio waves, and (v) physical contact.

3. The drilling assembly of claim 1 further comprising a downhole processor programmed to determine the orientation of the non-rotating member relative to the rotating member in response to a signal provided by the orientation sensing system.

4. The drilling assembly of claim 3 wherein the processor is programmed to steer the drilling assembly based on the determined orientation.

5. The drilling assembly of claim 3 wherein the processor determines the orientation of the non-rotating member based on a parameter of interest relating to the rotating member.

6. The drilling assembly of claim 5 wherein the parameter of interest is selected from one of (i) rotational speed, (ii) azimuth, (iii) inclination, and (iv) depth.

7. A drilling assembly for drilling a wellbore, comprising:

(a) a rotating member configured to be rotated by a surface rotary power source;

(b) a non-rotating sleeve surrounding a portion of the rotating member, the sleeve having a plurality of force application members, each member adapted to extend radially outward to engage a wall of the wellbore;

(c) a first member positioned on the non-rotating sleeve; and (d) an orientation sensing system associated with the rotating member that detects the first member and provides signals to determine an orientation of the non-rotating sleeve relative to the rotating member, wherein the first member includes a passive material, and the orientation sensing system includes a sensor adapted to detect the passive material.

8. The drilling assembly of claim 7 wherein the sensor is a magnetic pickup.

9. A method of operating a drilling assembly in a wellbore, comprising:

(a) positioning a rotating member relative to a non-rotating sleeve;

(b) rotating the rotating member using a surface rotary source;

(c) providing a plurality of force application members on the non-rotating sleeve, each member extending radially outward to engage a wall of the wellbore when energized; and (d) determining an orientation of the non-rotating sleeve relative to the rotating member from an orientation sensing system associated with the rotating member and the non-rotating sleeve using a downhole processor and wherein the orientation of the non-rotating sleeve relative to the rotating member is determined by detecting a first member positioned on the non-rotating sleeve.

10. The method of claim 9 further comprising positioning a second member in the rotating member.

11. The method of claim 10 wherein the first member includes a passive material, and the second member includes a sensor adapted to detect the passive material.

12. The method of claim 10 wherein the second member is a magnetic pickup.

13. The method of claim 9 further comprising steering the drilling assembly based at least in part on the determined orientation.

14. The method of claim 9 wherein determining the orientation of the non-rotating member is based on a parameter of interest relating to the drilling assembly.

15. The method of claim 14 further comprising selecting the parameter of interest from a group consisting of (i) rotational speed, (ii) azimuth, (iii) inclination, and (iv) depth.

16. A method of operating a drilling assembly in a wellbore, comprising:

(a) positioning a rotating member relative to a non-rotating sleeve;

(b) rotating the rotating member using a surface rotary source;

(c) providing a plurality of force application members on the non-rotating sleeve, each member extending radially outward to engage a wall of the wellbore when energized; and (d) determining an orientation of the non-rotating sleeve relative to the rotating member from an orientation sensing system associated with the rotating member and the non-rotating sleeve using a downhole processor (e) positioning a first member of the orientation system in the non-rotating sleeve and a second member in the rotating member; and (f) determining the orientation of the non-rotating sleeve relative to the rotating member from a coaction between the first and second members.

17. The method of claim 16 wherein the coaction between the first and the second member uses one of (i) magnetic waves, (ii) electrical signals, (iii) acoustic signals, (iv) radio waves, and (v) physical contact.

18. A drilling system for forming a wellbore in a subterranean formation, comprising:

(a) a derrick erected at a surface location;

(b) a drill string supported by the derrick within the wellbore, and being rotated therefrom;

(c) a mud source for providing drilling fluid via the drill string;

(d) a drilling assembly coupled to an end of the drilling string and including a drill bit and a drilling motor rotating the drill bit; and (e) a steering assembly associated with the drilling assembly having at least:

a rotating member coupled to and rotating with the drill string;

a non-rotating sleeve surrounding a portion of the rotating housing at a selected location thereof, the sleeve having a plurality of force application members, each member extending radially outward to engage a wall of the wellbore upon the supply of power thereto;

a first member positioned on the non-rotating sleeve; and an orientation sensing system associated with the rotating housing and the non-rotating sleeve that provides signals to determine an orientation of the non-rotating sleeve relative to the rotating member and wherein the orientation of the non-rotating sleeve relative to the rotating member is determined from detecting the first member.

19. The drilling system of claim 18 wherein the orientation sensing system includes a first member positioned in the non-rotating sleeve and a second member positioned in the rotating member.

20. The drilling system of claim 18 wherein the orientation of the non-rotating sleeve relative to the rotating member is determined from a coaction between the first and second members.

21. The drilling system of claim 18 wherein the orientation sensing system utilizes one of (i) magnetic waves, (ii) electrical signals, (iii) acoustic signals, (iv) radio waves, and (v) physical contact.

22. The drilling system of claim 18 further comprising a telemetry system providing a two-way telemetry link between the drilling assembly and a surface location.

23. The drilling system of claim 18 further comprising at least one downhole sensor adapted to detect one of (a) formation-related parameters; (b) drilling fluid properties; (c) drilling parameters; (d) drilling assembly conditions; (e) orientation of the non-rotating sleeve; and (f) orientation of the steering assembly.

24. The drilling system of claim 18 further comprising a processor adapted to steer the drilling assembly.

* * * * *

UNITED STATES PATENT AND TRADEMARK OFFICE

CERTIFICATE OF CORRECTION

PATENT NO. : 7,556,105 B2
APPLICATION NO. : 11/174768
DATED : July 7, 2009
INVENTOR(S) : Volker Kruger It is certified that error appears in the above-identified patent and that said Letters Patent is hereby corrected as shown below:

Column 12, claim 3, line 43, delete "member", insert --sleeve--;

Column 12, claim 5, line 50, delete "member", insert --sleeve--;

Column 13, claim 14, line 34, delete "member", insert --sleeve--;

Column 13, claim 16, line 48, delete "and";

Column 13, claim 16, line 52, delete "processor", insert --processor;--;

Column 14, claim 18, line 20, delete "the sleeve", insert --the non-rotating sleeve--;

Column 14, claim 20, line 37, delete "18", insert --19--; and

Column 14, claim 22, line 47, delete "a surface", insert --the surface--.

Signed and Sealed this

Second Day of February, 2010

David J. Kappos

David J. Kappos
*Director of the United States Patent and Trademark Office*